US006169372B1

(12) United States Patent
Kobayashi et al.

(10) Patent No.: US 6,169,372 B1
(45) Date of Patent: Jan. 2, 2001

(54) FIELD EMISSION DEVICE AND FIELD EMISSION DISPLAY

(75) Inventors: Hitoshi Kobayashi; Haruhiko Okumura, both of Kanagawa-ken (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/343,248

(22) Filed: Jun. 30, 1999

(30) Foreign Application Priority Data

Jun. 30, 1998 (JP) ..... H10-184914

(51) Int. Cl.[7] ..... G09G 3/10
(52) U.S. Cl. ..... 315/169.3; 315/371; 345/76
(58) Field of Search ..... 315/169.1, 169.3, 315/371; 345/204, 213, 55, 56, 76, 77

(56) References Cited

U.S. PATENT DOCUMENTS 5,347,201 * 9/1994 Liang et al. ..... 315/366
5,519,447 * 5/1996 Shima et al. ..... 315/371
5,831,398 * 11/1998 Kim ..... 315/371
5,910,792 * 6/1999 Hansen et al. ..... 315/169

FOREIGN PATENT DOCUMENTS 7-181916 7/1995 (JP) .

OTHER PUBLICATIONS

T. Leroux et al, "Microtips Displays Addressing", *SID 91 Digest*, pp. 437–439.

* cited by examiner

*Primary Examiner*—Haissa Philogene
*Assistant Examiner*—Thuy Vinh Tran
(74) *Attorney, Agent, or Firm*—Oblon, Spivak, McClelland, Maier & Neustadt, P.C.

(57) ABSTRACT

A field emission display and display driving method, wherein the display includes a plurality of cathode lines arranged in a first direction in parallel; a plurality of gate lines arranged in a second direction in parallel, perpendicular to the first direction and isolated from the cathode lines; a field emission device at a cross point of one of the cathode lines and one of the gate lines, including an anode, an emitter connected to the one of the cathode lines, and a gate connected to the one of the gate lines; a scanning circuit configured to apply a scanning signal to one of the gate lines; and a modulating circuit configured to form a modulated signal synchronized with the scanning signal from an image signal having intensity information. The modulated signal has a plurality of pulse width modulated waveforms, each having a duty cycle indicative of the brightness of a corresponding picture element of the image signal, wherein successive waveforms have a level transition (high to low or low to high) that is inverted from the level transition of the immediately prior waveform, each of the waveforms beginning a period at one of two signal levels (high or low) and ending the period at the other (low or high) of the two signal levels. In one embodiment, a first cathode line has applied thereto a first pulse width modulated signal which begins the period at one of the two signal levels, and simultaneously a second cathode line has applied thereto a second pulse width modulated signal which begins the period with the other of the two signal levels.

26 Claims, 10 Drawing Sheets

| | j | j+1 | j+2 |
|---|---|---|---|
| i | 1 | 5 | 5 |
| i+1 | 5 | 1 | 2 |
| i+2 | 2 | 0 | 1 |
| i+3 | 0 | 2 | 0 |

FIG. 6

FIELD EMISSION DEVICE AND FIELD EMISSION DISPLAY

CROSS REFERENCE TO RELATED APPLICATIONS

This application claims benefit of priority to Japanese Patent Application No. H10-184914 filed Jun. 30, 1998, the entire disclosure of which is incorporated by reference herein.

BACKGROUND OF THE INVENTION

1. Field of the Invention

The present invention relates to field emission displays (FEDs) including field emission devices as electron sources.

2. Discussion of the Background

Currently devices utilizing field emission devices are being developed. Examples of such devices include image display devices, ultra-high speed microwave devices, power devices and electron beam devices. Applications to image display devices are especially attracting attention, because field emission devices make it possible to provide field emission displays (FEDs) which are self-emitting thin image display devices.

A field emission display includes an array of field emission devices connected by cathode lines and gate lines that are electrically isolated from each other. Each field emission device includes a cathode, a gate, and an emitter. The field emission devices are arranged to form a display.

Control signals are applied to the field emission display to generate potential differences between the emitters, gates, and anode to thereby cause electrons to be emitted from the emitters to the anode to impinge on the fluorescent elements and thereby cause light emission. The emission from the fluorescent element is adjusted by varying the potential differences between the emitters and the gates emitted with a predetermined potential applied to the anode to control the number of electrons. Scan signal potentials are applied to the gates, and image signal potentials are applied to the emitters to display an image. An image may alternatively be displayed by applying scan signal potentials and image signal potentials to the emitters and gates, respectively.

FEDs can be made thin even with a large screen because, unlike displays utilizing a cathode ray tube (CRT), there is no need for polarizing electron beams emitted by a cathode. Further, because they do not have electron beams that impinge obliquely upon fluorescent elements, FEDs do not have a problem with distortion of an image at the edges of a display screen.

Liquid crystal displays (LCDs) have a problem with viewing angle characteristics. Contrast characteristics fluctuate depending on the viewing angle because LCDs display images utilize polarized light. FEDs lack this problem. Specifically, light emitted by FEDs is scattered light because electron beams impinge upon fluorescent elements to excite the fluorescent elements for emission of light by the resultant energy.

In plasma display panels (PDPs), the operational principal is the display of black, but often the displayed black appears undesirably whitish because a slight background light stays on. In contrast, FEDs can display black realistically because FEDs emit no light when displaying black, thereby to provide images with high contrast.

FEDs are also advantageous in that high definition image displays can be fabricated with FEDs because pixels can be formed compactly. FEDs utilizing field emission devices are thus quite advantageous.

To produce a color display, pixels in an image display are configured by arranging fluorescent elements in the three primary colors (e.g., red, green and blue) in the form of stripes or deltas. Emitters or gates are switched based on an image signal to cause emission of light from the fluorescent elements. Further, gray levels are formed to allow display of natural colors in each of the three primary colors.

Known methods for creating gray levels include the analog modulation method, dither method and pulse width modulation method.

The analog modulation method is a method for creating gray levels widely used in LCDs. In LCDs, the transmittance of the liquid crystal varies depending on the electric field (potential difference) applied to the liquid crystal and creates gray levels by controlling the potential difference applied to the liquid crystal. FEDs can also create gray levels based on the analog modulation method because the current discharged by the emitters varies depending on potential differences applied between the gates and emitters.

FIG. 3 shows an example of the gate-emitter potential difference versus the number of electrons emitted by the emitter of a field emission device. As shown in FIG. 3, no electron is emitted by the emitter when the potential difference between the gate and emitter is equal to or smaller than a threshold (Vth), and the number of electrons emitted by the emitter gradually increases after the threshold is exceeded. Therefore, the current discharged by the emitter can be controlled by the potential difference between the gate and emitter.

The dither method is used in various types of images displays including LCDs. For example, according to Japanese Patent Laid-Open Publication No. 7-320664, one pixel is formed by sixty small areas. In this case, the number of light-emitting small areas is increased with the distance from the central region, when the pixel is to be brighter.

The pulse width modulation method is often used in plasma display panels (PDPs). In PDPs, the emission from the fluorescent elements used therein varies depending on the duration of the generation of plasma. Specifically, luminance is varied by switching two states, i.e., emitting and non-emitting states, frequently to control the duration of emission per unit time. Gray scales are displayed in some cases (e.g., Japanese Patent Laid-Open No. 8-221031) by applying the pulse width modulation method to surface conduction electron emitters.

The above-described three methods for displaying half tones may be adopted for FEDs utilizing field emission devices. However, all of these methods result in problems when simply applied to FEDs.

When the analog modulation method is used, waveforms of potentials as illustrated in FIG. 9, for example, are applied to the emitters when the image shown in FIG. 6 is displayed. FIG. 6 represents a part of a display panel of a display, and the figures in the squares represent levels of luminance. The number 0 represents the minimum luminance (black), and the number 7 represents the maximum luminance (white). The term 1H represents one scan period. A potential equivalent to the level is applied as a scan signal to the gate of each row for the 1H period. FIG. 9 shows that signal potentials are applied to the emitters in synchronism with the scan signal. Therefore, the amount of emitted electrons is controlled by the difference between the scan signal to the gates and the signals to the emitters.

A problem with this method is that fluctuation of potential difference-current characteristics over time directly results in fluctuation of the luminance of emission. That is, the display of gray levels is deteriorated by continued use.

A problem with the dither method is that the area of pixels is inevitably increased with the number of gray levels because of an increase in the number of small areas A problem with using the pulse width modulation method is that field emission devices are likely to fail. Power consumption is increased because the potentials of image signals applied to the field emission devices are more frequently increased and decreased than in the analog modulation method and dither method.

FIG. 10 is a timing diagram showing examples of waveforms of potentials applied to display the image shown in FIG. 6 based on a conventionally used pulse width modulation system. The term 1H represents one scan period. An "H" level of an image signal is a potential applied to display with the minimum luminance (black). For example, a potential difference between a scan signal and an image signal or a potential difference between a gate and an emitter is set equal to or lower than a threshold voltage (Vth). An "L" level of an image signal is set equal to a gate-emitter potential difference that causes emission of light to provide display with the maximum luminance (white).

As apparent from a comparison between FIGS. 9 and 10, the emitter potentials are more frequently increased and decreased according to the pulse width modulation method than in the analog modulation method. That is, the pulse width modulation method results in greater power consumption than the analog modulation method. Power consumption is calculated by (pixel capacity×the number of times the emitter potentials are increased and decreased (frequency)× the square of the applied potential difference). The applied potential difference represents a potential difference between an "H" level and an "L" level according to the pulse width modulation method and represents a potential difference between a level 0 (black) and a level 7 (white) according to the analog modulation method. It is assumed here that the pixel capacity is the same for both methods and that the potentials at the "H" and "L" levels are equal to the potential at the levels "0" and "7", respectively.

The above-described problems become more significant as the number of pixels of the image display becomes greater. Specifically, as the number of times the emitter potentials are increased and decreased (frequency) increases, the current supplied by the drivers increases, and this results in a need for significantly improving the charge supplying capability of the drivers.

SUMMARY OF THE INVENTION

Accordingly, one object of the present invention to solve the above-described problems of the prior art image displays.

Another object of the present invention is to reduce failures of emitters by reducing the number of times the potentials of signals applied to the emitters are increased and decreased.

It is a further object of the present invention to further reduce loads to drivers by suppressing the amount of charges supplied to emitters.

These and other objects are achieved according to the present invention by providing a novel field emission device including an anode; an emitter; a gate; a signal circuit configured to apply a first signal to one of the emitter and the gate; and a modulating circuit configured to form a modulated signal from a second signal having intensity information and synchronized with the first signal, the modulated signal having successively an LH waveform which is one of a group to begin a low level and an HL waveform which is one of a group to begin a high level, the modulated signal being applied to another of the emitter and the gate.

The present invention is also directed to a method for controlling a field emission device having an emitter connected to a cathode line, a gate connected to a gate line, and an anode, including forming a first signal having intensity information; forming a modulated signal having successively a low-to-high level transition (LH) waveform and a high-to-low level transition (HL) waveform in correspondence with the intensity information of the first signal; applying a second signal to the gate line; and applying the modulated signal to the cathode line synchronized with the second signal.

According to a further aspect of the present invention, there is provided a plurality of field emission devices arranged in a two-dimensional configuration and connected in the form of a matrix with gate lines in the direction of rows and cathode lines in the direction of columns, a scanning signal circuit configured to scan the gate lines on a row-by-row basis to display gray levels using pulse width modulation signals based on image signals input to the cathode lines. According to the pulse width modulation method, there are two types of waveforms applied as scan signals. A first waveform has a potential level that changes from an "L" level to an "H" level, and a second waveform has a potential level that changes from the "H" level to the "L" level. The two types of potential waveforms are alternately used for consecutive scan periods, but may be alternately applied for each column or may be applied such that they alternate in consecutive scan periods and alternate for each column.

According to the present invention, a signal generator generates a modulation signal by combining a plurality of pulse signals based on an input image signal and applies the modulation signal to input ends of lines in the direction of columns, thereby forming gray scales without increasing the size of pixels. The pulse signal to generate the modulation signal are signals to use field emission devices only in two states, e.g., on and off states. Even if the pulse signals are affected by fluctuations of current-potential difference characteristics over time, the only result is a shift of the characteristics of the devices as a whole and not a variation of luminance. Further, the applied modulation signal may be a combination of a potential waveform changing from an "L" level to an "H" level and a potential waveform changing from the "H" level to the "L" level which alternate for each scan period to reduce the number of times a potential applied to a device is increased and decreased. This makes it possible to reduce the failure of the devices. Signals simultaneously applied to column lines may be two types of potential waveforms that alternate, which makes it possible to suppress the amount of charges supplied by drivers.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 6 illustrates an illustrative portion of a display image for describing the prior art and the present invention.

DETAILED DESCRIPTION OF THE PREFERRED EMBODIMENTS

Figure 1:
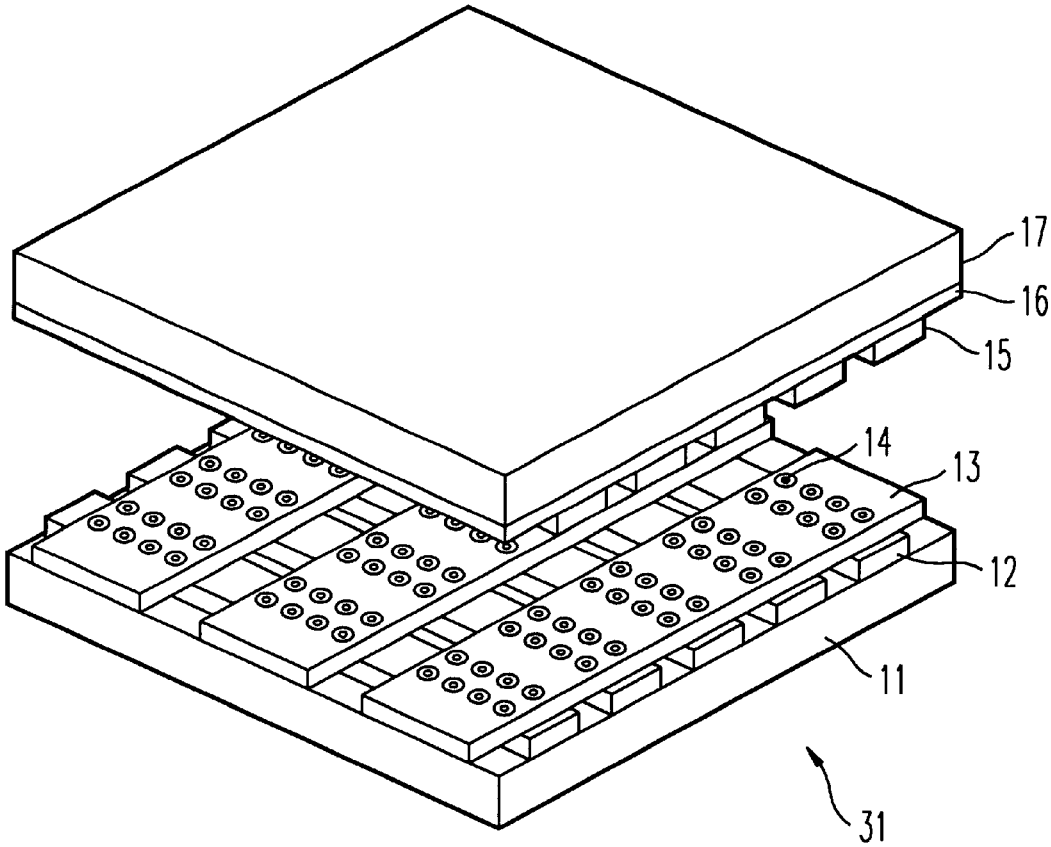
FIG. 1 is a perspective view illustrating a field emission display in accordance with the present invention.
Figure 2:
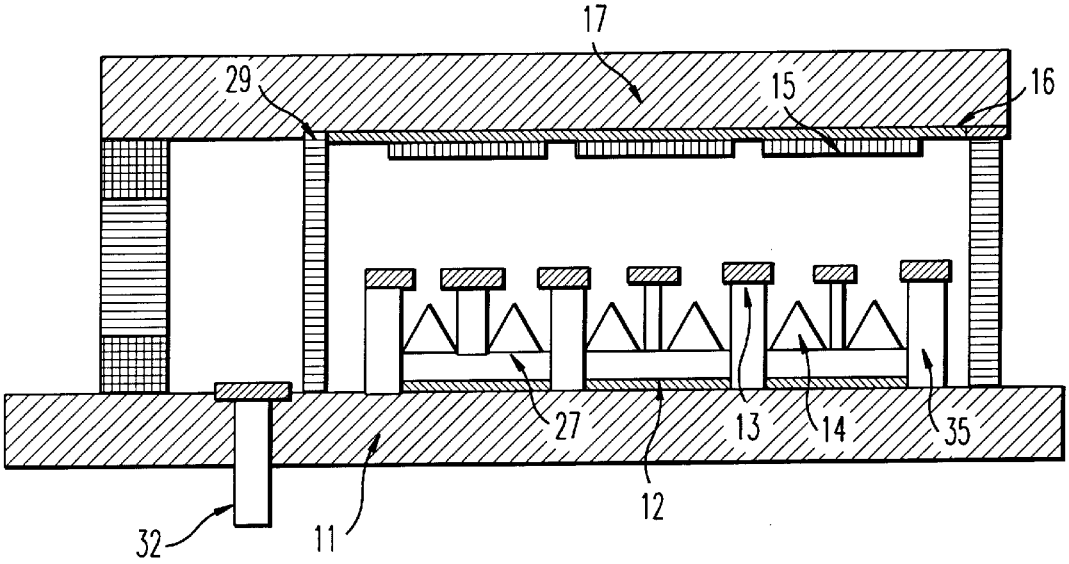
FIG. 2 is a cross-sectional view of the field emission display of FIG. 1 in accordance with the present invention.

Referring now to the drawings, wherein like reference numerals designate identical or corresponding parts throughout the several views, an example of a configuration of an FED according to the present invention is now described with reference to FIG. 1 which is a perspective view illustrating a field emission display in accordance with the present invention, and FIG. 2 which is a cross-sectional view of the field emission display of FIG. 1. As shown in FIGS. 1 and 2, the field emission display includes a display panel 31 that includes a substrate 11, a plurality of cathode lines 12, a plurality of gate lines 13, a plurality of emitters 14, a plurality of fluorescent elements 15, an anode 16, and a counter substrate 17, a plurality of resistive layers 27 and a insulator layer 35. A field emission device is formed of an emitter, a gate, and an anode.

The counter substrate 17 is disposed above and spaced apart from the substrate 11. The plurality of cathode lines 12 is arranged as stripes and disposed on the substrate 11. One of the plurality of resistive layers 27 is formed on each of a corresponding one of the plurality of cathode lines 12. The plurality of emitters 14 is further formed thereon in the form of an array. The cathode lines 12 and emitters 14 are electrically connected. An insulation layer (not shown) is disposed between the cathode lines 12 and gate lines 13. The emitters 14 are surrounded by the insulation layer. While a configuration including the resistive layers 27 is illustrated, a configuration without a resistive layer 27 may be employed.

The anode 16 is disposed on a bottom surface of the counter substrate 17. The plurality of fluorescent elements 15 in three colors is disposed on the anode 16 to allow color display.

The field emission display also includes a spacer 29, and an evacuation pipe 32. The substrate 11 and counter substrate 17 are sealed at the edges and are kept spaced apart at a certain distance by the spacer 29. Gases in the space enclosed by the sealed substrate 11 and counter substrate 17 are evacuated by the evacuation pipe 32.

When potential differences are generated between the emitters 14, gates 13 and anode 16, electrons are emitted by the emitters 14 to the anode 16 to cause the fluorescent elements 15 on the counter substrate 17 to emit light. The emission from the fluorescent elements 15 is adjusted by varying the potential differences between the emitters 14 and gates 13 to control the number of electrons emitted with a predetermined potential applied to the anode 16. Scan signal potentials are applied to the gates 13 and image signal potentials are applied to the emitters 14 to display an image. An image may alternatively be displayed by applying scan signal potentials and image signal potentials to the emitters 14 and gates 13, respectively.

Figure 3:
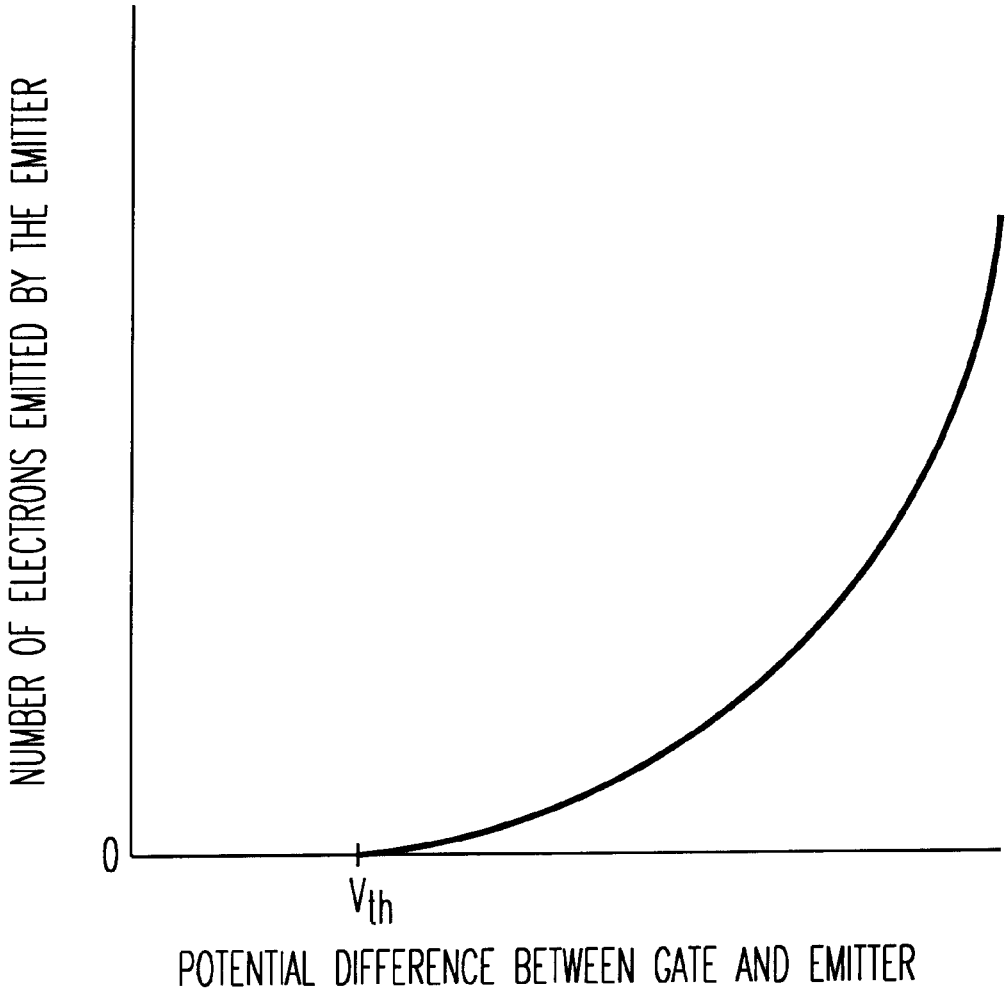
FIG. 3 illustrates characteristics of a field emission device usable in field emission displays according to the prior art.

FIG. 3 illustrates an emission characteristic of a field emission device in the form of a diagram showing the number of electrons emitted by the emitter versus the potential between the gate and emitter of the field emission device.

The following two points are to be noted about the quantity of emitted electrons. First, emission of electrons abruptly begins when the potential difference between the gate and emitter equals or exceeds a threshold potential difference (Vth), and substantially no emission occurs below Vth. That is, it is a non-linear device having a distinct threshold potential difference Vth for the discharged current. Second, the quantity of emitted electrons varies depending on the potential difference between the gate and emitter. It is therefore possible to control the magnitude of the discharged current with the potential difference between the gate and emitter.

The field emission device is therefore suitable for use in an image display. Specifically, a potential difference equal to or greater than Vth is applied between the gate and emitter of a field emission device in a selected (driven) state, and a potential difference smaller than Vth is applied to a device in an unselected (undriven) state. As a result, electrons are emitted from field emission devices in a selected state to illuminate the pixels of the devices.

Signal processing in the FED is now described with reference to FIG. 4.

Figure 4:
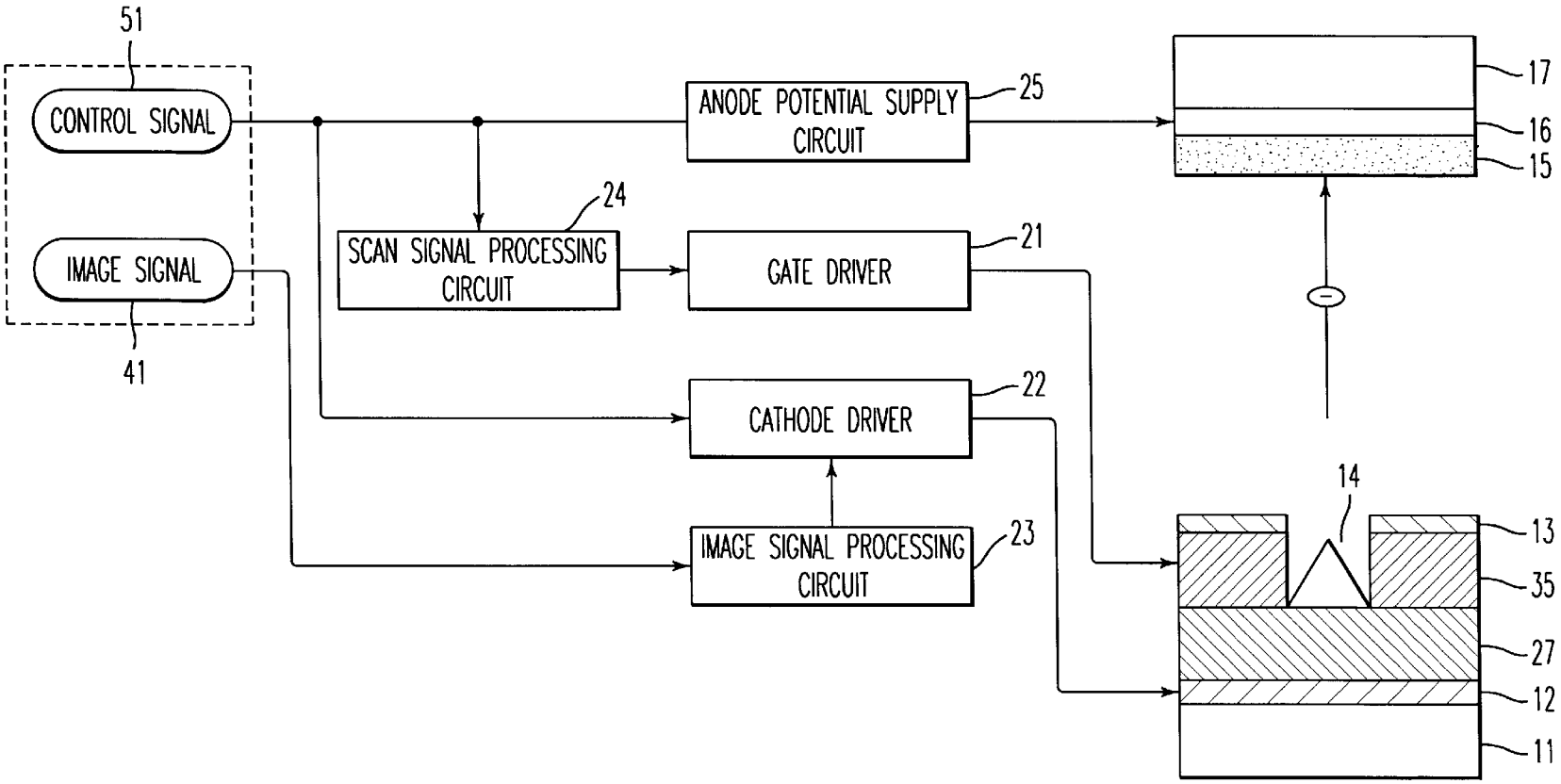
FIG. 4 is a schematic diagram illustrating a field emission display according to the present invention.

FIG. 4 is a schematic diagram illustrating the field emission display in accordance with one embodiment of the present invention. The field emission display includes a gate driver 21, a cathode driver 22, an image signal processing circuit 23, a scan signal processing circuit 24, and an anode potential supply circuit 25. An electronic device, such as a television tuner or a personal computer, provides an image signal 41 to the image signal processing circuit 23, and also provides a control signal 51 to the cathode driver 22, the anode potential supply circuit 25, and the scan signal processing circuit 24. In response to the control signal 51, the anode potential supply circuit 25 supplies a predetermined potential to the anode 16.

In response to the control signal 51, the scan signal processing circuit 24 generates a scan signal which is applied to the gate driver 21. The gate driver 21 applies the scan signal to the gate lines 13. A gate line 13 is independently provided for each of the rows to which predetermined potentials are applied sequentially for one scan period (1H) from the top of the screen.

The image signal processing circuit 23 shapes the image signal 41 into a form in accordance with the display to be provided by the FED and is thereafter applied to the cathode driver 22. The cathode driver 22 applies a modulation signal to the cathode line 12 for each column in synchronism with the scan signal. A cathode line 12 is independently provided for each column in the direction of the columns on the screen, e.g., in the direction perpendicular to the gate lines 13.

Therefore, electrons are emitted only in the rows to which the potential from the gate driver 21 is applied for a period in accordance with the modulation signal on the cathode lines 12. Thus, an image is displayed in each row, and one screen is scanned from top to bottom to reproduce the image.

To create gray scales, the number of electrons emitted by the field emission devices is controlled by the duration of the applied potential differences between the gates 13 and emitters 14. Specifically, the present invention utilizes the characteristic of the field emission device that the emission of electrons can be turned on and off using Vth as a threshold. The integral of electrons per unit time is recognized by human eyes as luminance.

A description is now made of the waveforms of potentials applied to the emitters 14 according to the phase inverted pulse width modulation method. According to the pulse width modulation method of the present invention, the waveform of a potential signal applied in each scan period is inverted at every 1H period.

Figure 5A:
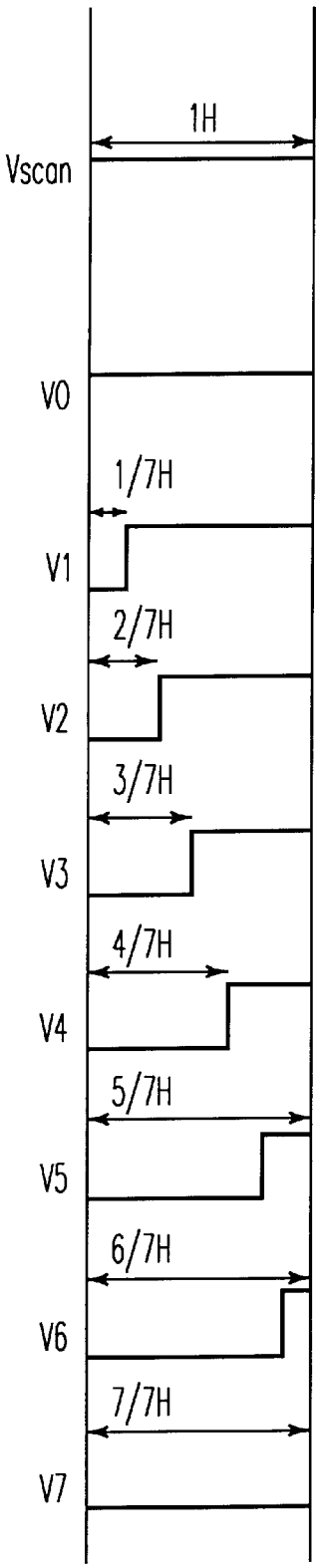
FIGS. 5A and 5B are graphs illustrating examples of waveforms of potential levels applied to the field emission display according to the present invention.
Figure 5B:
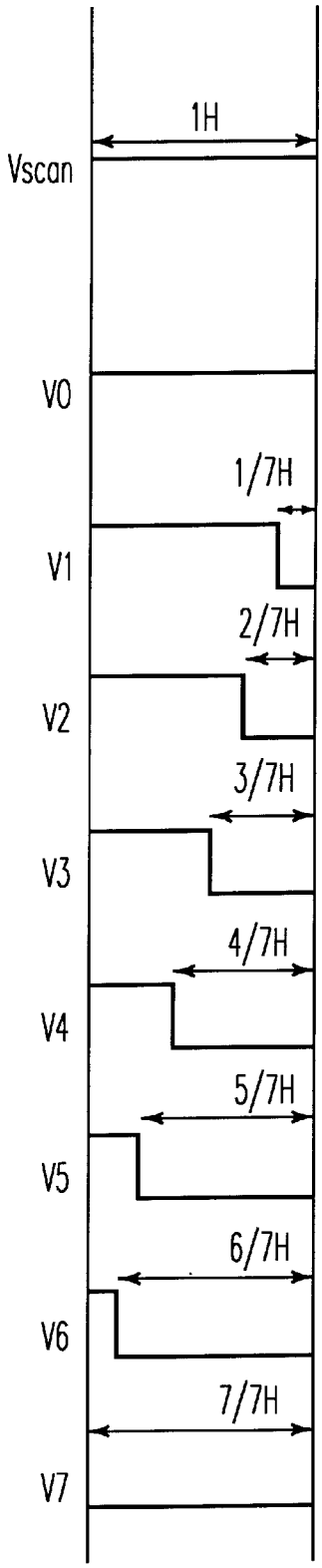

FIGS. 5A and 5B are graphs illustrating examples of the waveforms of potentials applied to the cathode lines 12 in accordance with the present invention. The term 1H represents one scan period during which a potential at an "H" level is applied to one selected gate line 13. The following description refers to display of luminance in eight gray scales tones as an example.

The "H" level of an image signal applied to a cathode line 12 is a potential applied to the display with the minimum luminance (black). Specifically, the "H" level is applied to both of the gate line 13 and the emitter 14 at the intersections of the selected gate lines 13 and cathode lines 12, and no potential difference is generated between the gates and emitters. As a result, no electron is emitted by the emitters. It is not essential to set the potential applied to the gate lines 13 equal to the "H" level of an image signal because no electron is emitted if the gate-emitter potential difference is set equal to or smaller than the threshold voltage Vth.

The "L" level is set at an application potential which provides luminance for display with the maximum luminance (white). Again, because the potential applied to selected gate lines 13 is at the "H" level, the difference between the "H" and "L" levels is the potential difference between the gates and emitters.

In FIGS. 5A and 5B, eight levels of luminance are represented by V0 through V7. At luminance 0 (V0), the "H" level is applied throughout a 1H period to display the pixel in black. At luminance 1 (V1), the "L" level is applied for 1/7 of a 1H period, and the "H" level is applied for the rest of the 1H period. At luminance 2 (V2), the "L" level is applied for 2/7 of the 1H period. At luminance 3 (V3), the "L" level is applied for 3/7 of the 1H period. At luminance 4 (V4), the "L" level is applied for 4/7 of the 1H period. At luminance 5 (V5), the "L" level is applied for 5/7 of the 1H period. At luminance 6 (V6), the "L" level is applied for 6/7 of the 1H period. At luminance 7 (V7), the "L" level is applied throughout a 1H period to cause maximum emission.

According to the present invention, two groups of signals in accordance with luminance are provided as shown in FIGS. 5A and 5B. Specifically, one group of signals has a 1H period starting at the "L" level (FIG. 5A: LH waveforms) and the other group of signals has a 1H period ending at the "L" level (FIG. 5B: HL waveforms).

Then, a group of potential waveforms as shown in FIGS. 5A or 5B is applied to the cathode line of each row such that LH waveforms and HL waveforms alternate. Specifically, when the "L" level is applied at the beginning of a 1H period, the "L" level is applied at the end of the next 1H period. Then, the "L" level is applied at the beginning of the next 1H period.

Figure 7:
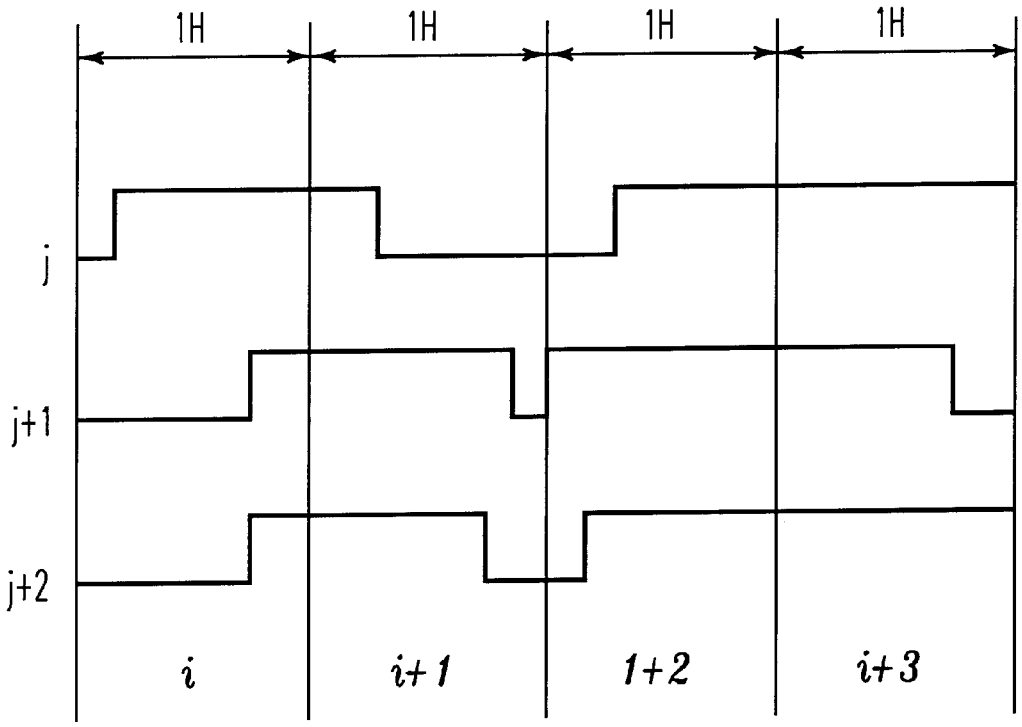
FIG. 7 is a graph illustrating examples of waveforms of potentials applied to a field emission display according to the present invention.

FIG. 6 is a pictorial view showing an illustrative portion of a display image in accordance with the present invention. FIG. 7 is a graph illustrating examples of wave forms of potentials applied to a field emission display in accordance with the present invention. Specifically, FIG. 7 shows the waveforms of potential differences applied to display the image shown in FIG. 6.

Specifically, FIG. 6 shows a part of an image display portion which is a region extending from an i-th row to a (i+3)-th row and extending from a j-th column to a (j+2)-th column. Each square represents a pixel, and the number therein represents the luminance of the pixel.

When a scanning potential is applied to the gate line of the i-th row, waveforms among the group of LH waveforms shown in FIG. 5A in accordance with the luminance are applied to the cathode lines in the j-th through (j+2)-th columns. When the pixel positions are represented on a matrix basis, the waveforms V1, V5 and V5 among the group of LH waveforms are applied to (i, j) and (i, j+1), (i, j+2), respectively.

A scan potential is applied to the gate line of the (i+1)-th row in the next 1H period. At this time, a waveform among the group of HL waveforms in accordance with the luminance is applied to the cathode line of each column. Specifically, V5, V1 and V2 among the HL waveforms are applied to (i+1, j), (i+1, j+1) and (i+1, j+2), respectively.

Thus, waveforms are selected depending on the luminance from the group of waveforms as shown in FIG. 5A or 5B and are applied such that LH waveforms and HL waveforms alternate to provide the display image.

Figure 10:
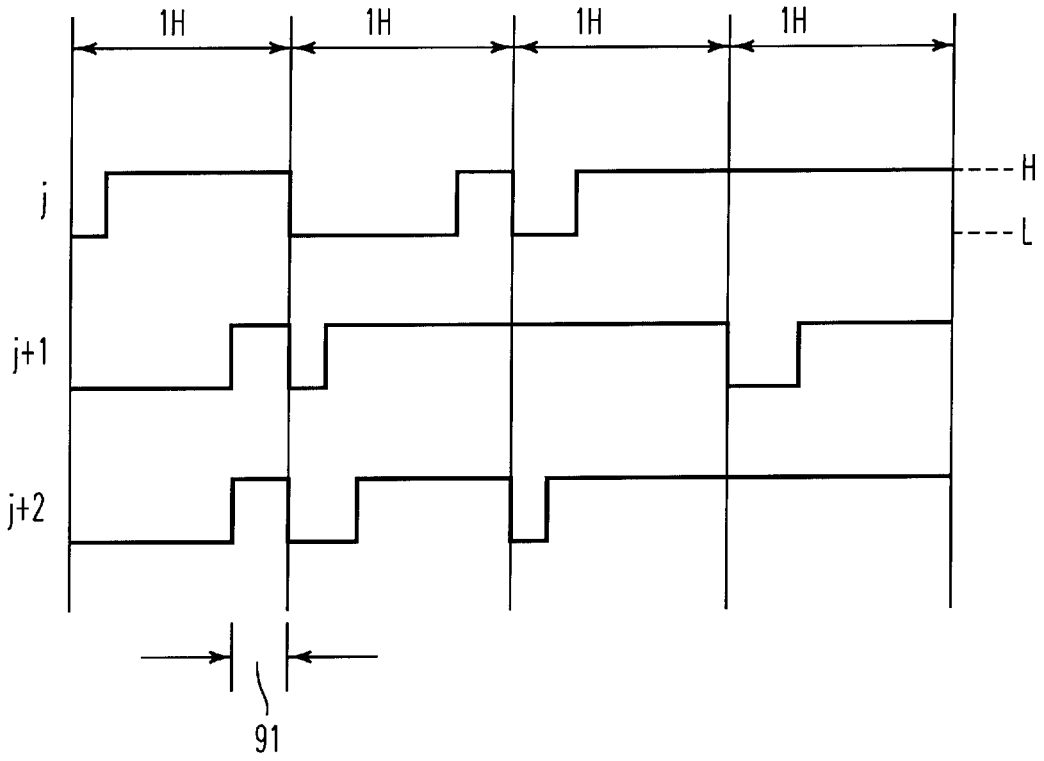
FIG. 10 PRIOR ART
FIG. 10 is a timing diagram showing examples of waveforms in a prior art pulse width modulation method.

FIG. 10 is a graph illustrating pulse width modulation used in the prior art. The conventional pulse width modulation method (FIG. 10) and the phase inverted pulse width modulation method of the present invention (FIG. 7) are compared with reference to display of an image as shown in FIG. 6.

The number of times in which potentials of applied signal waveforms are increased and decreased is now compared. In the case of the example of the prior art shown in FIG. 10, potentials of the applied signal waveforms are changed five times in each of the j-th, (j+1)-th and (j+2)-th columns. According to the present invention as shown in FIG. 7, potentials of the applied signal waveforms are changed three times in the j-th column, four times in the (j+1)-th column and three times in the (j+2)-th column. Therefore, in the region extending from the i-th row to the (i+2)-th row and extending from the j-th column to the (j+2)-th column, the total number of times the potentials are increased and decreased is 15 in the example of the prior art, whereas the total number is reduced to ten according to the present invention. That is, power consumption can be reduced by 33% (5/15) compared to the example of the prior art. Power consumption P can be calculated by:

$$P=CfV^2$$

where C represents the capacity of a pixel; f represents an applied frequency; and V represents an applied potential difference. It is assumed that the pixel capacity C and the applied potential difference V are the same for both methods and that the applied frequency is the number of times the potential applied to the emitter is increased and decreased. The present invention makes it possible to achieve a reduction of power consumption as great as 50% depending on the image to be displayed. Further, since the number of times the potentials applied to the emitters is increased and decreased is reduced, wear of field emission devices can be reduced to extend the life of the devices.

Thus, according to this embodiment of the present invention, potential waveforms applied to the cathode lines of each row can be alternately selected from among a group of LH waveforms and a group of HL waveforms for each scan period to reduce power consumption. Further, since the number of times the potentials applied to the emitters is increased and decreased is reduced, noises generated by an image signal may be reduced.

A second embodiment of the present invention is now described in detail with reference to the potential waveform diagram of FIG. 8. The amount of charge supplied from drivers can be reduced by alternately applying luminance waveforms selected from among a group of LH waveforms and a group of HL waveforms to the cathode line of each of adjoining rows.

Figure 8:
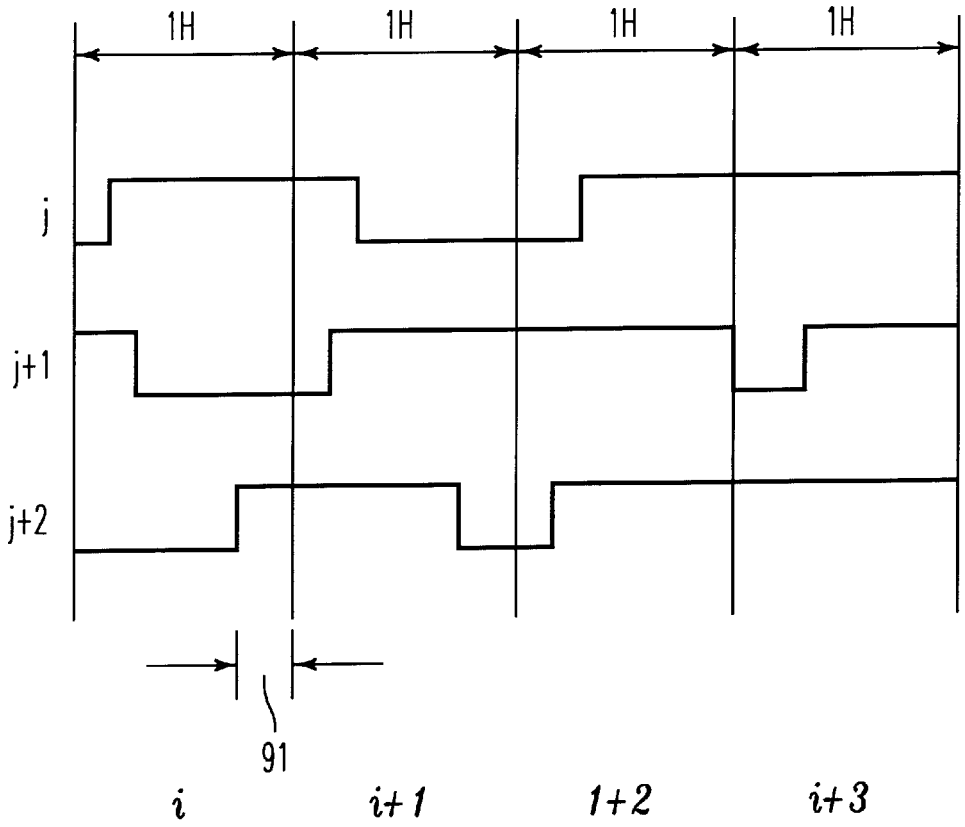
FIG. 8 is a diagram illustrating an example of potential waveforms applied to a field emission display according to a second embodiment of the present invention.
Figure 9:
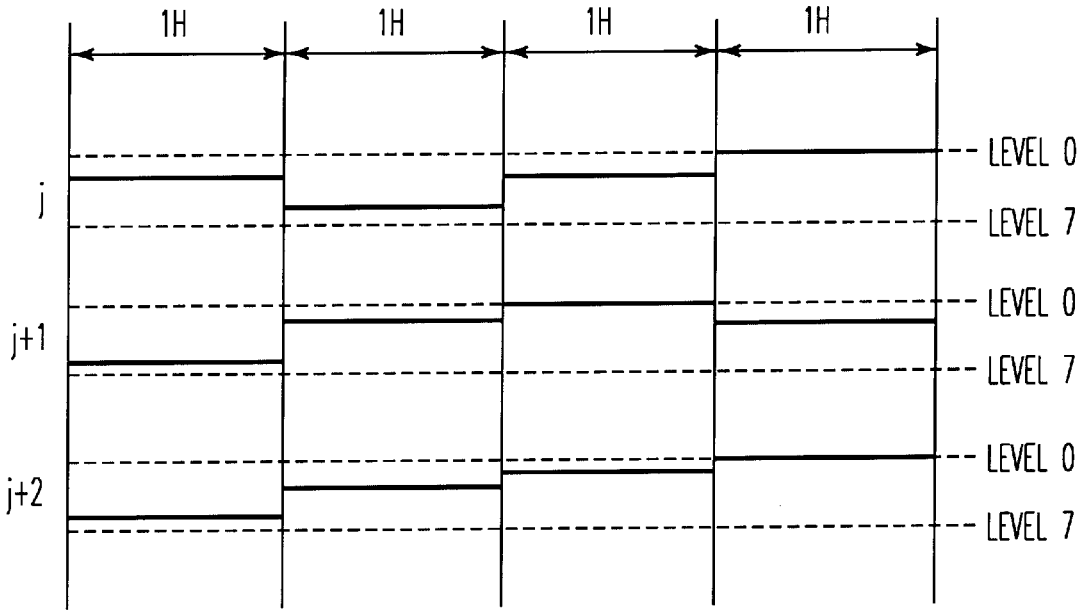
FIG. 9 PRIOR ART
FIG. 9 is a diagram illustrating a prior art analog modulation method.

In particular, FIG. 8 shows examples of the waveforms of potentials applied to display the image shown in FIG. 6. In this embodiment, an LH waveform, an HL waveform and an LH waveform are applied in the order listed to the emitter of the j-th column, and an HL waveform, an LH waveform and an HL waveform are applied in the order listed to the (j+1)-th emitter adjacent thereto.

That is, adjoining columns have alternating LH and HL waveforms in a 1H period in which a certain scan line, e.g., the i-th row is selected. By applying different potential waveforms to the cathodes of adjoining columns simultaneously, it is possible to suppress the amount of charge supplied by the drivers simultaneously.

For example, while all of the j-th, (j+1)-th and (j+2)-th columns are at the "H" level in a 1/7 period 91 at the end of the first 1H period in FIG. 10, the j-th, (j+1)-th and (j+2)-th columns are respectively at the "H" level, "L" level and "H" level in the same 1/7 period 91 in FIG. 8. That is, while all of the j-th, (j+1)-th and (j+2)-th columns emit light in FIG. 10 showing an example of the prior art in the 1/7 period 91, the j-th and (j+2)-th columns emit no light and only the (j+1)-th column emits light in FIG. 8 showing the present invention. Thus, a reduction of about 33% can be achieved in the amount of charge supplied to the cathodes of all columns.

By applying alternating LH and HL waveforms to adjoining columns as described above, the amount of charge supplied from the drivers simultaneously may be reduced. This allows reduction of cross talk and prevents variations of luminance attributable to a shortage of the amount of charge supplied to display pixels. It is also possible to compensate for luminance between adjoining pixels, which is also effective in reducing variation of luminance.

The alteration of the order of applied potential waveforms does not result in any increase in the number of times the potentials are increased and decreased as described above. The present invention achieves a reduction of power consumption over the prior art thereby to reduce device failure.

While this embodiment of the present invention has referred to the application of LH and HL waveforms that alternate for each pixel, they may be similarly alternated less frequently, such as every third or fourth pixel. The present invention allows power consumption to be reduced and the life of field emission devices to be extended. The present invention also prevents variation of luminance to thereby improve image quality.

Obviously, numerous modifications and variations of the present invention are possible in light of the above teachings. It is therefore to be understood that within the scope of the appended claims, the invention may be practiced otherwise than as specifically described herein.

What is claimed is:

1. A method for controlling a field emission device having an emitter connected to a cathode line, a gate connected to a gate line, and an anode, comprising:

forming a first signal having intensity information;

forming a modulated signal having successively a low-to-high level transition (LH) waveform and a high-to-low level transition (HL) waveform in correspondence with the intensity information of the first signal;

applying a second signal to the gate line; and applying the modulated signal to the cathode line synchronized with the second signal;

wherein the modulated signal has successively the LH transition waveform and the HL transition waveform in turn.

2. The method of claim 1, wherein the modulated signal has successively the LH transition waveform and the HL transition waveform occurring with regularity.

3. A method for controlling a field emission display having a two dimensional array of field emission devices, each of the field emission devices having an emitter connected to one of a plurality of cathode lines, a gate connected to one of a plurality of gate lines and an anode, and the cathode lines oriented in a first direction in the field emission devices array, and the gate lines arranged in a second direction perpendicular to the first direction and isolated from the cathode line, the method comprising:

forming an image signal having intensity information;

forming a modulated signal having successively a low-to-high (LH)transition waveform and a high-to-low level transition (HL) waveform in correspondence with the intensity information of said image signal;

applying a scanning signal to one of the gate lines; and applying the modulated signal to one of the cathode lines synchronized with the scanning signals;

wherein the modulated signal has successively the LH transition waveform and the HL transition waveform in turn.

4. The method of claim 3, wherein the modulated signal has successively the LH transition waveform and the HL transition waveform occurring with regularity.

5. The method of claim 3, wherein the modulated signal having successively the LH transition waveform and the HL transition waveform in a scanning period.

6. The method of claim 3, wherein the modulated signal has a step shape.

7. The method of claim 3, wherein the step of forming the modulated signal comprises forming the modulated signal with a duty ratio corresponding to the intensity information of the image signal.

8. The method of claim 3, wherein the step of forming the modulated signal comprises varying modulated signal between two electric potential levels.

9. The method of claim 3, comprising:

forming a pixel at a junction of a set of the cathode lines and a set of the gate lines.

10. A method for driving a field emission display having a two dimensional array of field emission devices, one of the field emission devices having an emitter connected to a cathode line, a gate connected to a gate line and an anode, and the cathode lines having a first direction relative to the field emission devices array, and the gate lines having a second direction perpendicular to the first direction and isolated from the cathode line, the method comprising:

forming an image signal having intensity information;

forming a modulated signal having successively an LH transition waveform beginning with a low level and an HL transition waveform beginning with a high level in successive periods in correspondence with intensity information of the image signal;

applying an enable signal to one of the cathode lines in turn; and applying the modulated signal to one of the gate lines synchronized with the scanning signal;

wherein the modulated signal has successively the LH transition waveform and the HL transition waveform in turn.

11. A driving method for a field emission display having a two-dimensional array of field emission devices, one of the field emission devices having an emitter connected to a cathode line, a gate connected to a gate line and an anode, and the cathode lines having a first direction of the field emission devices array, and the gate lines having a second direction perpendicular to the first direction and isolated from the cathode line, the method comprising:

forming an image signal having intensity information;

forming a first modulated signal having successively an LH transition waveform extending over plural sub-periods and beginning with a low level and an HL transition waveform extending over plural sub-periods beginning with a high level in correspondence with intensity information of the image signal;

forming a second modulated signal having successively an HL transition waveform extending over plural sub-periods and beginning with a high level and an LH transition waveform extending over plural sub-periods beginning with a low level in correspondence with intensity information of the image signal;

applying a scanning signal to one of the gate lines; and applying the first and second modulated signals simultaneously to respective of adjacent sets of said cathode lines synchronized with a scanning period.

12. The method of claim 11, wherein the modulated signal has successively the LH transition waveform and the HL transition waveform in turn.

13. The method of claim 11, wherein the modulated signal has successively the LH transition waveform and the HL transition waveform occurring with regularity.

14. The method of claim 11, wherein one of the sets of cathode lines consists of a cathode line.

15. The method of claim 11, wherein the step of forming the first and second modulated signals comprises forming the first and second modulated signals in a step shape.

16. The method of claim 11, wherein the step of forming the first and second modulated signals comprises forming the first and second modulated signals with a duty ratio corresponding to the intensity information of the image signal.

17. The method of claim 11, wherein the step of forming the first and second modulated signal comprises varying the first and second modulated signals between two electric potential levels.

18. The method of claim 11, comprising:

forming a pixel at a junction of a set of the cathode lines and a set of the gate lines.

19. A field emission device comprising:

an anode;

an emitter;

a gate;

a signal circuit configured to apply a first signal to one of the emitter and the gate;

a modulating circuit configured to form a modulated signal from a second signal having intensity information and synchronized with the first signal, the modulated signal having successively an LH transition waveform extending over plural sub-periods and beginning with a low level and an HL transition waveform extending over plural sub-periods beginning with a high level in correspondence with intensity information of the first signal, the modulated signal being applied to the other of the emitter and the gate;

wherein the modulated signal has successively the LH transition waveform and the HL transition waveform in turn.

20. A field emission display comprising:

a plurality of cathode lines arranged in a first direction in parallel;

a plurality of gate lines arranged in a second direction in parallel, perpendicular to the first direction and isolated from the cathode lines;

a field emission device at a cross point of one of the cathode lines and one of the gate lines, comprising an anode, an emitter connected to the one of the cathode lines, and a gate connected to the one of the gate lines;

a scanning circuit configured to apply a scanning signal to one of the gate lines;

a modulating circuit configured to form a modulated signal synchronized with the scanning signal from an image signal having intensity information, the modulated signal having successively an LH transition waveform extending over plural sub-periods and beginning with a low level and an HL transition waveform extending over plural sub-periods beginning with a high level in correspondence with intensity information of the first signal.

21. The display of claim 20, wherein the modulated signal has successively an LH transition waveform and an HL transition waveform in turn.

22. The display of claim 20, wherein the modulated signal has successively an LH transition waveform and an HL transition waveform with a regularity.

23. The display of claim 20, wherein the LH transition waveform and the HL transition waveform are simultaneously applied to respective adjacent sets of cathode lines in synchronism with a scanning period.

24. The display of claim 20, comprising a pixel formed at a cross point of a set of the cathode lines and a set of the gate lines.

25. A method for controlling a field emission device having an emitter connected to a cathode line, a gate connected to a gate line, and an anode, the method comprising:

forming a pulse width modulated signal indicative of an image signal, the modulated signal having a plurality of pulse width modulated waveforms, each of the plurality of pulse width modulated waveforms having a duty cycle indicative of the brightness of a corresponding picture element of the image signal, wherein successive waveforms have a level transition that is inverted from the level transition of the immediately prior waveform, each of the waveforms beginning a period at one of two signal levels and ending the period at another of the two signal levels;

applying an enable signal to the gate line; and applying the pulse width modulated signal to the cathode line synchronized with an enable signal.

26. The method of claim 25, comprising:

simultaneously applying respective pulse width modulated signals to plural cathode lines, including applying to a first cathode line a first pulse width modulated signal which begins the period at one of the two signal levels, and simultaneously applying to a second cathode line a second pulse width modulated signal which begins the period with the other of the two signal levels.

* * * * *